US009839567B2

(12) United States Patent
Hacikadiroglu et al.

(10) Patent No.: US 9,839,567 B2
(45) Date of Patent: Dec. 12, 2017

(54) MOBILITY DEVICE FOR PHYSICALLY DISABLED PEOPLE

(75) Inventors: Necati Hacikadiroglu, Istanbul (TR); Enes Canidemir, Istanbul (TR)

(73) Assignee: Matia Robotics Mekatronik Sistemler AR-GE Muhendislik Yazilim Sanayi ve Ticaret Anonim Sirketi, Dudullu, Istanbul (TR)

( * ) Notice: Subject to any disclaimer, the term of this patent is extended or adjusted under 35 U.S.C. 154(b) by 195 days.

(21) Appl. No.: 14/009,005

(22) PCT Filed: Mar. 29, 2012

(86) PCT No.: PCT/EP2012/055617
§ 371 (c)(1),
(2), (4) Date: Sep. 30, 2013

(87) PCT Pub. No.: WO2012/130930
PCT Pub. Date: Oct. 4, 2012

(65) Prior Publication Data

US 2015/0190293 A1 Jul. 9, 2015

(30) Foreign Application Priority Data

Mar. 29, 2011 (DE) ..... 10 2011 006 359

(51) Int. Cl.
*A61G 7/14* (2006.01)
*A61G 5/14* (2006.01)
(Continued)

(52) U.S. Cl.
CPC ..... *A61G 5/14* (2013.01); *A61G 5/04* (2013.01); *A61G 5/1089* (2016.11);
(Continued)

(58) Field of Classification Search
CPC ..... A61G 7/14
(Continued)

(56) References Cited

U.S. PATENT DOCUMENTS 3,629,880 A 12/1971 van Rhyn
5,117,516 A * 6/1992 Penner ..... A61G 7/1017 5/81.1 R
(Continued)

FOREIGN PATENT DOCUMENTS

DE 43 04 757 A1 8/1994
DE 44 11 399 A1 10/1995
(Continued)

OTHER PUBLICATIONS

EP Office Action dated Oct. 6, 2014 for EP Application No. 12 712 630.8.
(Continued)

*Primary Examiner* — Fredrick Conley
(74) *Attorney, Agent, or Firm* — Nixon & Vanderhye P.C.

(57) ABSTRACT

Mobility device for physically disabled people 1, comprising a chassis 10 with at least one motor for maneuvering the entire mobility device 1; a pivot arm 20, which at its lower end 22 is pivotably connected to the chassis 10; and a pelvis support 40, which is connected to an upper end 23 of the pivot arm 20; wherein a physically disabled person 2 can sit with the pelvis support 40 attached to its body, can move around with the mobility device 1 in a standing position on the chassis 10, and can change on its own from sitting to standing position, wherein all elements of the mobility device 1 except the elements directly contacting the body of the person 2 extending above pelvis height h of the sitting person 2 can be lowered or moved to or below this height h. The present invention further comprises a method for erecting of a sitting physically disabled person 2 and for fixing of the person 2 in standing position onto a motor-driven mobility device 1.

26 Claims, 17 Drawing Sheets

Figure 1:
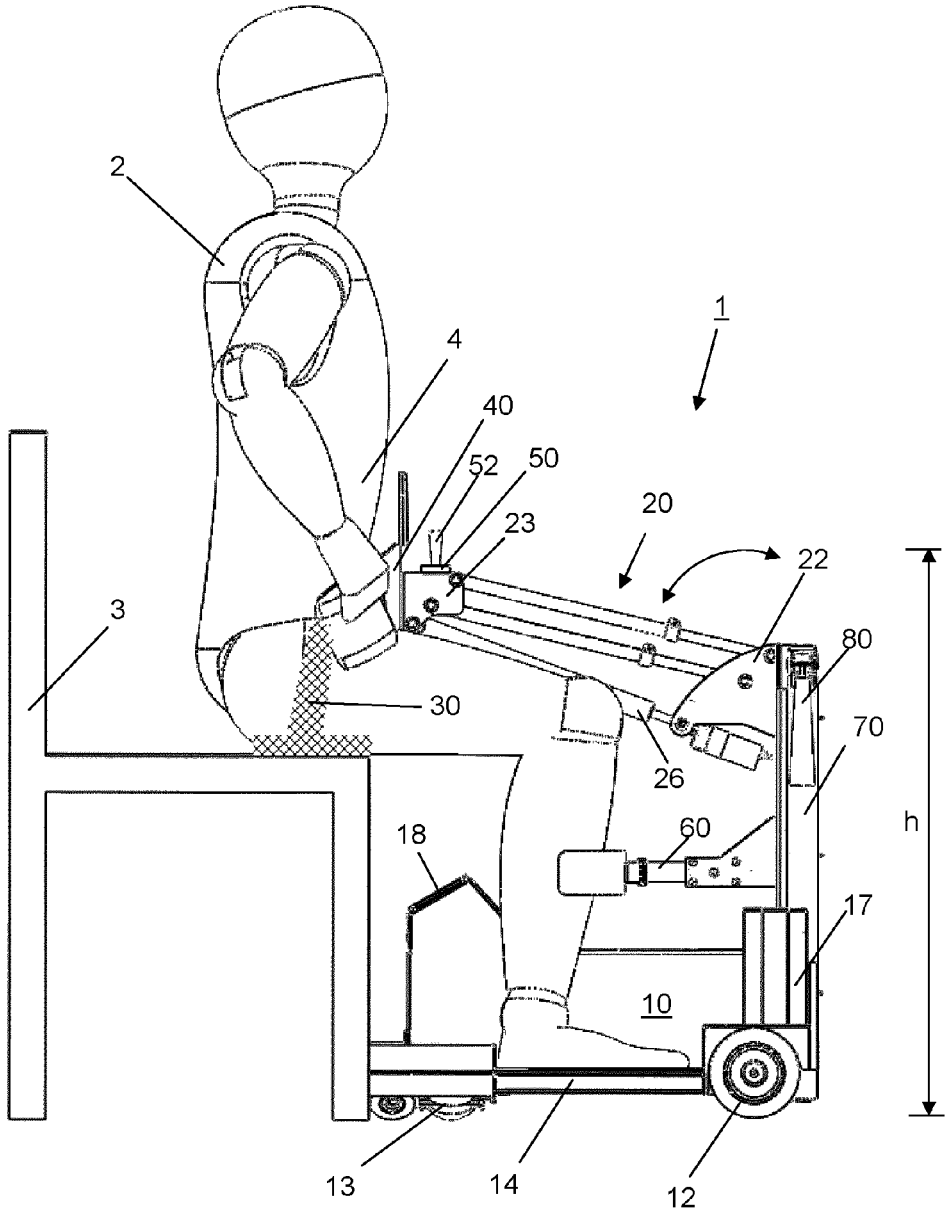

(51) Int. Cl.
*A61G 7/10* (2006.01)
*A61G 5/04* (2013.01)
*A61G 5/10* (2006.01)

(52) U.S. Cl.
CPC ..... *A61G 7/1017* (2013.01); *A61G 7/1019* (2013.01); *A61G 7/1096* (2013.01); *A61G 2203/14* (2013.01); *A61G 2203/30* (2013.01); *A61G 2203/32* (2013.01)

(58) Field of Classification Search
USPC ..... 5/86.1, 83.1, 81.1 R, 89.1
See application file for complete search history.

(56) References Cited

U.S. PATENT DOCUMENTS

| | | | | |
|---|---|---|---|---|
| 5,309,584 | A * | 5/1994 | Parker | 5/87.1 |
| 6,092,247 | A * | 7/2000 | Wilson | A61G 7/1011 5/81.1 R |
| 6,119,287 | A * | 9/2000 | Phillips | A61G 7/1017 5/81.1 RP |
| 7,356,858 | B2 * | 4/2008 | Summers | 5/83.1 |
| 7,392,554 | B1 * | 7/2008 | Su | A61G 7/1017 5/86.1 |
| 2009/0119835 | A1 * | 5/2009 | Liljedahl | A61G 5/00 5/87.1 |
| 2010/0076360 | A1 | 3/2010 | Shimada et al. | |

FOREIGN PATENT DOCUMENTS

| | | |
|---|---|---|
| DE | 11 2006 002 551 T5 | 9/2008 |
| GB | 2 346 361 | 8/2000 |
| JP | 2011-19571 | 2/2011 |
| WO | WO 96/11658 | 4/1996 |
| WO | WO 2010/140560 | 12/2010 |

OTHER PUBLICATIONS

German Office Action dated Nov. 7, 2013.
International Search Report for PCT/EP2012/055617, dated Jul. 17, 2012.
Written Opinion of the International Searching Authority for PCT/EP2012/055617, dated Jul. 17, 2012.
Japanese Office Action dated Apr. 16, 2015 for JP Application No. 2014-501614.

* cited by examiner

MOBILITY DEVICE FOR PHYSICALLY DISABLED PEOPLE

This application is the U.S. national phase of International Application No. PCT/EP2012/055617, filed 29 Mar. 2012, which designated the U.S. and claims priority to DE Application No. 10 2011 006 359.5, filed 29 Mar. 2011, the entire contents of each of which are hereby incorporated by reference.

1. FIELD OF THE INVENTION

The present invention relates to a mobility device for physically disabled people which enables that physically disabled people can freely move inside and outside of buildings without additional help and can perform tasks of daily life.

2. PRIOR ART

Mobility devices for disabled people are nowadays provided in the kind of manually or electrically driven wheelchairs. By means of such devices the mobility of physically disabled people has heavily improved in daily life. Such electric or manual wheelchairs have the disadvantage of its high space consumption, such that some places within or outside a building are hardly or not at all accessible. Wheelchairs in general are designed such the person can sit thereon. Correspondingly, they are provided with a seat respectively seat faces or seat cushions.

In newer developments the mobility of physically disabled people is further improved in that the wheelchairs allow an erection of the person from the seated position into a standing or inclined lying position.

It is common to all electric or manual wheelchairs that it is difficult for the physically disabled person to access the seat of the wheelchair from a seated position for example out of the bed or out of seating furniture. To this end, in the prior art lifting devices are proposed as they are disclosed for example in the U.S. Pat. No. 5,411,044, the U.S. Pat. No. 4,704,749, the U.S. Pat. No. 4,569,094 or the U.S. Pat. No. 7,392,554 B1. By means of such lifting devices the physically disabled person in general by means of a helping person can lift itself for example out of the bed and can be seated into a wheelchair.

The WO 96/11658 discloses a posture change system wherein a patient is fixed to an arm that can be moved up and down for changing the posture of the patient from a sitting one to a standing position and vice versa. In one embodiment the posture change system comprises a seat and driving wheels for the patient to move freely to a destination without the help of an attendant. This lifting device is disadvantageous in that it is mainly intended to be used in a hospital, wherein helping persons support the patient during a posture change. Therefore, the device is very bulky and comprises a handle by which helping persons can move the device. Therefore, the device shown is hardly suitable to be used by physically disabled persons in daily life on their own and to improve their quality of life.

From the U.S. Pat. No. 6,446,742 B1 a motor-driven platform vehicle for physically disabled people is known, in which the person can move around motor-driven standing on a platform. However, it is a disadvantage of this vehicle, that like with common wheelchairs, the user can enter the vehicle only with difficulties and that it is very space consuming since it is designed for the outdoor use. Therefore, it can only be used in a very limited way within buildings.

Based on the above mentioned prior art, it is a problem of the present invention to provide a mobility device for physically disabled people that overcomes the above mentioned disadvantages and which provides an improved mobility and freedom especially for physically disabled people. Particularly, the mobility of physically disabled people should be improved within buildings such that they require less external help in daily life and require less devices like wheel chairs, lifting devices or the like. Further, by means of the present invention, the use of different common seating furniture should be enabled. Further, the free movement of the person within buildings should be enabled without the need for a transfer from a seating furniture or bed into a wheelchair.

3. SUMMARY OF THE INVENTION

The above mentioned problems are solved by a mobility device for physically disabled people, as well as by a method for erecting a seated physically disabled person and for fixing the physically disabled person in standing position onto a self-driven mobility device.

Particularly, the above mentioned problems are solved by a mobility device for physically disabled people comprising a chassis with at least one motor for maneuvering the overall mobility device, a pivot arm, which is at its lower end pivotably mounted to the chassis, and a pelvis support which is mounted at an upper end of the pivot arm, wherein a physically disabled person can sit with attached pelvis support and can move around in a standing position on the chassis by means of the mobility device and can on its own change from seated to standing position and wherein all elements of the mobility device except the elements directly contacting the body of the person extending above waist height of the sitting person can be lowered or maneuvered to this height or below.

Since the pelvis support is connected to an upper end of a pivot arm that is pivotably connected to the chassis the person in the course of the day can be fixed to the mobility device over a longer period of time without the need to sit or stand continuously on the mobility device. The person can use arbitrary seating furniture and still remains connected to the mobility device. If the person desires to reach a different place the person can erect itself by means of the pivot arm and the pelvis support at the mobility device to a standing position and can drive on the mobility device in a standing position to the desired place. The person can thus use the mobility device continuously throughout the whole day without the need to disconnect from the mobility device. Further, by the exclusive mounting by means of the pelvis support the physically disabled person can fix itself to the device and use it without the aid of a helping person.

If desired, the person can lower itself again onto seating furniture or a bed. Thereby, a transfer from seating furniture into a wheelchair and from the wheelchair to another seating furniture is completely omitted. Correspondingly, the person is relieved from this cumbersome activity and overall significantly gains mobility. Thereby, the times in which the physically disabled person remains seated in a wheelchair is decreased, what has particularly favorable effects on the health of the person.

By means of moving around in standing position with the help of the mobility device the person is enabled to perform activities of the daily life like washing, cooking, working etc. in a significantly facilitated manner or such tasks are enabled at all. The reach of a physically disabled person increases up to 80% of the reach of a non-disabled person.

Since all elements of the mobility device extending above waist height of the seated person—that are usually required for driving around in a standing position—can be lowered or manoeuvred below this height it is possible to move the mobility device for example below a common table such that the disabled person can sit and work at a table without disconnecting from the mobility device. This allows easy and fast changes of the position during the course of the day. Further, the mobility device does not impair the vision to the front if the person is sitting and for example watches TV. On the other hand a good support and safe transport of the person is possible if the elements are raised to the required height. It is particularly required to have handles or grips above waist height, for example in the height of 1.2 m to enable the person to pull himself/herself up to the standing position on its own.

Usually the waist height of a seated person using the mobility device is about 0.5 m-0.85 m from the ground, preferably about 0.55 m-0.75 m, and more preferred about 0.6 m-0.7 m from the ground. In some unusual cases the waist height may be in a different height, for example for very large or very small people or unusual seating furniture. In this respect the mobility device is adjustable to the actual person and the furniture used. In any case it is important for the present invention that all elements of the mobility device during use by a seated person that extend above waist height can be lowered to this height or below to enable perfect vision for the person and the use of common tables or other furniture. Elements directly contacting and supporting the body may of course remain above waist height. So, for example the pelvis support may be elongated upwards to such an extent that a support of the upper body of the physically disabled person is made possible. Fixing belts or the like may also extend above waist height without impairing the functionality of the mobility device.

Therefore, the mobility device essentially improves the quality of life of physically disabled people. By the fixing of the physically disabled person by means of a pelvis support at a pivotable pivot arm, the person is also not hindered in its freedom to move the upper body and to use common seating furniture. For example the person may reach wall units of kitchen furniture without any problems. Additionally the physically disabled person can fix itself on its own to the pelvis support of the mobility device and does not require external help. Further, no limitation of the visibility is given for a seated person that is fixed to the mobility device. In total, by means of a mobility device a physically disabled person can perform almost all tasks of daily life without external help what significantly increases its quality of life.

Preferably the mobility device further comprises a hand grip arrangement that is movably supported, preferably telescopically supported at the chassis, wherein the hand grip arrangement allows the physically disabled person to erect himself/herself on its own to a standing position. The hand grip arrangement can also be made foldable.

Preferably the hand grip arrangement of the mobility device for physically disabled people comprises two hand grips that are foldable downwards. In order to further decrease the overall height of the mobility device if required the hand grips can be folded downwards.

Preferably the pivot arm and the hand grip arrangement can be maneuvered to a height above waist height of a sitting person. This enables a self-erecting of the person and a safe driving around with the mobility device in standing position.

Preferably the mobility device has no seat for a person. This allows using arbitrary seating furniture during the course of the day, and not having to disconnect and to newly connect the mobility device to the body. A continuous "wearing" the mobility device during the day allows fast and easy changes of the position in the house without the need for changing into a wheelchair or the like.

Preferably, at least one fixing belt is mounted at the pelvis support. This fixing belt acts for fixing the person in a convenient way to the pelvis support and enables that the person may remain fixed permanently to the mobility device. The physically disabled person, therefore, in daily life can constantly wear the mobility device as if it would be a piece of clothing without being negatively affected while sitting.

Preferably the mobility device comprises an upper fixing belt for supporting the upper part of the body of a physically disabled person and a lower fixing belt for fixing the pelvis of a physically disabled person. This two-part design of the fixing belt provides a better stability for driving. Further the fixing belts fixes the upper part of the body of the person during the motion for seating in which the person has to push its body backwards from the hand grip arrangement in order to sit down out of the standing position.

Preferably, at least one of the fixing belts is retractable into the pelvis support. Therefore, the length of the fixing belt can be individually adjusted and individually adapted during the course of the day according to the fact if the person sits or stands.

In a preferred embodiment the pivot arm can be pivoted to a height below and above waist height of a sitting person such that the pelvis support contacts the belly of a sitting person, a sitting person is able to erect himself/herself to a standing position, and the pelvis support can fix the belly or the frontal pelvis of the person and holds the person upright in a standing position on the mobility device. By such an arrangement of the pivot arm respectively the pelvis support a "wearing" in the sense of a fixing of a mobility device is enabled during sitting as well as during erecting and driving by means of the mobility device. Since the pelvis support contacts the belly or the frontal pelvis of the person, it is not cumbersome particularly during sitting and enables that the person may enter the mobility device from the backside thereof, and may erect himself/herself without the need of further assistance from the backside into the standing position. Correspondingly, arbitrary seating furniture can be used during the course of the day and it is possible to change between seats or to drive around in a very fast and simple way.

Preferably, the pivot movement of the pivot arm to the standing position of the person is supported by a spring, preferably by a lockable spring, and more preferably by a lockable gas spring. By means of a mechanical support of the pivot movement of the pivot arm by a spring or gas spring an erecting of a person from a sitting position into a standing position onto the mobility device is facilitated. The spring or gas spring generates a lifting force that makes it easier for the person to erect himself/herself. In contrary to a motor driven lifting the person has the full control of the lifting process which is particularly advantageous or even necessary since physically disabled people sometimes have so called "locked knees" that do temporarily not allow to straighten the legs. If in this condition the pivot arm would be motor driven the user may be severely injured by the device since the legs would be straightened by a motor.

Preferably the pivot arm can be selectively locked to provide at least two of the following modes:

a. free mode, such that the pivot arm can move up and down;

b. locked mode, such that the pivot arm can neither move up nor down;

c. standing up mode, such that the pivot arm can only move up but cannot move down; and d. sitting down mode, such that the pivot arm can only move down but can not move up.

By choosing one of the above described modes the lifting and lowering of the pivot arm can be controlled according the desired task.

Preferably the pivot arm is length adjustable in order to adjust the mobility device to the user and to allow a greater range of movements.

Preferably the mobility device further comprises two footrests as standing platforms at the chassis for a person standing onto the mobility device, wherein the footrests are arranged in between front wheels and back wheels. Preferably the footrests are arranged at the chassis just over the floor, such that a use of common furniture in the household is possible. Particularly, it is possible to grasp and position articles onto a common table also in the standing position of the person. Further an overall low height of the mobility device is given. By means of these footrests—in contrast to a single platform—the fixing and stability of the person in standing position onto the mobility device is improved since the feet take a defined position. The arrangement of the footrests in between the front and back wheels further increases the stability of the mobility device and makes the mobility device as compact as possible.

Preferably the footrests are movable in height by means of a motorized mechanism. This allows on the one hand a perfect sitting on seating furniture while the feet of the person remain on the mobility device. On the other hand this allows an effortless lifting of the upper legs of the person for an easy fixing of the preferred belt for attaching to the mobility device.

Preferably the pivot arm is arranged as a parallelogram arrangement, such that the pelvis support during pivoting of the pivot arm always has the same orientation. This measure improves the comfort and the security of the fixing particularly during erecting from the sitting position.

Preferably the pivot arm further comprises a gearbox arrangement for maintaining the orientation of the pelvis support, while pivoting the pivot arm. The gearbox arrangement preferably comprises a first gearbox at one end of the pivot arm, a second gearbox at the other end of the pivot arm, a rotatable connection shaft, connecting the input shafts of the first and second gearbox with each other, wherein a rotatable output shaft of the first gearbox is attached to the pelvis support and a rotatable output shaft of the second gearbox is attached to the chassis. By using a gearbox arrangement at the pivot arm for maintaining the orientation of the pelvis support the risk of injuring the fingers or hand at the pivot arm is minimized respectively excluded compared to a pivot arm with a parallelogram arrangement. Further, since the gearbox arrangement translates the pivot movement into a rotational movement of the connection shaft the locking mechanism of the pivot arm must be less powerful compared to a pivot arm with parallelogram arrangement. Particularly the gearbox arrangement can increase the rotational movement of the pivot arm by ten times for the connection shaft. Therefore, the connection shaft can preferably be used for coupling to a support drive, for example an electric motor.

Preferably the mobility device further comprises a removable support post arranged rigidly on the chassis, wherein the pivot arm is supported at the chassis via the support post. By means of the support post, it is possible to provide the support of the pivot arm in a height adjustable manner, such that the mobility device can be optimally adapted to the corresponding person. Further, it enables to form the centre of gravity of the mobility device as deep as possible and to design the chassis in total as compact as possible. Since the support post is removable the device is easier to be transported, for example by car.

Preferably the lower end of the pivot arm is height displaceably supported at the support post in order to adapt the mobility device to the user.

Preferably the chassis comprises driven wheels, which are selectively driven by at least one motor, to manoeuvre the mobility device. By the selective drive of the wheels the mobility device can be steered and manoeuvred by the user in arbitrary directions.

Preferably the mobility device comprises at least one multiway wheel. A multiway wheel is an arrangement of a plurality of wheels and has more than one rotation axis such that it can rotate in different rotational directions. Multiway wheels allow for example a forward and a sideward movement perpendicular thereto. By means of a multiway wheel at the back of the chassis it is possible to rotate the mobility device around the front wheels, such that actions of a daily life—which require often a rotation of the mobility device—can be done very easily and without driving forwards and backwards. This additionally improves the mobility and reach of the physically disabled people.

Preferably the mobility device further comprises at least one omni wheel and/or at least one caster wheel and/or a holonomic drive, comprising four omni wheels arranged at the edges of the chassis and/or a meccanum drive, comprising at least two meccanum wheels.

These wheels and drives also allow that the mobility device is more agile and can move directly in any desired direction—for example sideways—without the need for space consuming driving maneuvers.

Preferably the mobility device further comprising stability elements that are extendable and retractable from the chassis in order to provide an enhanced stability of the mobility device. These stability elements can be automatically extended out of the chassis to improve tilting stability, for example in case the user in standing position leans forward or if the user erects himself/herself to the standing position. If the stability elements are not required they are automatically retracted into the chassis to minimize the footprint required by the mobility device.

Preferably the mobility device further comprises a tibia support, which is connected to the support post in an adjustable manner. The tibia support secures a stable stand of the physically disabled person on the mobility device.

Preferably, the mobility device further comprises a control panel at which the person can control the movements of the mobility device, particularly the driving movements.

Preferably the control panel is a remote control panel that allows the user to manoeuvre the mobility device from a remote distance. This allows fetching the mobility device from a parking position in order to use it. Further, for example, this allows the person to carry a tray and simultaneously to control the mobility device. To do so the person can place the remote control panel onto the tray and control it by its fingers.

Preferably the mobility device comprises at the back end of the chassis a platform for supporting the feet of the person, such that the person can more easily fix the fixing belt to its body. Such a platform allows an effortless lifting of the feet and the upper legs of a sitting person such that the preferred belt can easily be fixed to the body of the person.

The above mentioned height movable footrests can be used additionally or instead of the platform.

Preferably the platform is adjustable in height by means of a motorized mechanism. Thereby, the platform can be moved upwards for an easy lifting of the upper legs and for an attaching of the fixing belt. For an easy mounting of the mobility device it can be moved downwards.

The above mentioned problems are also solved by a method for erecting of a sitting physically disabled person and for fixing the person in standing position onto a motor-driven mobility device comprising the following steps; (a) providing a mobility device comprising a motor driven manoeuvrable chassis, a pivot arm pivotably mounted at the chassis, a pelvis support arranged at an upper end of the pivot arm, and a hand grip arrangement that can be lowered to or below the waist height of the sitting person, (b) fixing the pelvis support at the belly of the sitting person, (c) moving the hand grip arrangement to a height that allows the person to pull himself/herself up to the standing position by means of the hand grip arrangement, and (d) pivoting of the pivot arm for erecting the person into the standing position onto the chassis of the mobility device.

Since the pelvis support is connected to the belly of a seated person and the pivot arm for erecting the person into the standing position is pivoted, the above mentioned advantages of the mobility device are given. Particularly the advantage is provided that the sitting person can erect itself at the mobility device without the requirement for additional lifting devices or the like. Further, this erecting is particularly simple by the connection of the pelvis support at the belly of the sitting person and usually can be done by the sitting person by muscle force or by mechanic support by the person on its own and without external help. To this end the person preferably pulls itself up at the hand grip arrangement which is adjusted to a sufficient height.

The retractable hand grip arrangement does not impair the vision to the front if the person is sitting and allows parking the device below a table. Correspondingly, the physically disabled person will use the mobility provided by the mobility device more frequently compared to the case if for this task additional devices, respectively helping persons would be required.

Preferably, the step of the fixing of the pelvis support requires an encompassing of the person by means of a fixing belt wherein the person places his/her feet to a back sided edge platform or height movable platform of the chassis in order to lift its upper legs. If only a fixing belt is used, which encompasses the person at its back the person can use arbitrary seating furniture and nevertheless remains securely fixed to the mobility device for a fast change of the location. The use of a particular back sided edge or height movable platform of the chassis to place the feet during the fixing lifts the upper legs of the person such that the belt can be fixed easily.

Preferably the pelvis support laterally supports the knees of the seated person during encompassing of the person by means of the fixing belt. During the encompassing of the person by means of the fixing belt it was found out, that it is favourable to laterally support the knees of the seated person temporally by means of the pelvis support. Than the person—if desired—can push itself away from the seat without any problems in order to secure the fixing belt.

Preferably the pivoting of the pivot arm is supported by a spring or is motor driven. This facilitates the lifting of the person into the standing position.

Further preferred embodiments result from the sub-claims.

4. SHORT DESCRIPTION OF THE DRAWINGS

Figure 2:
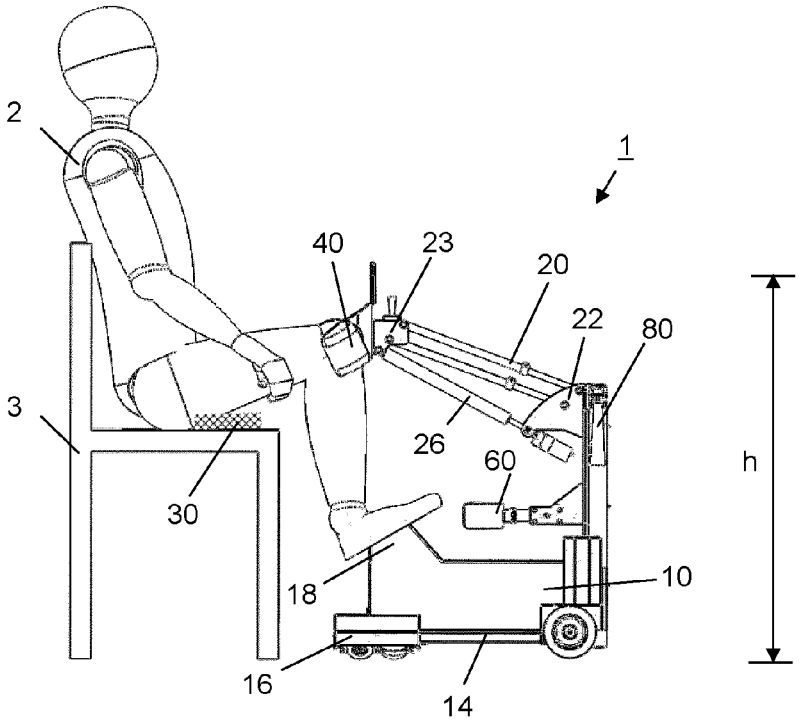
Figure 3:
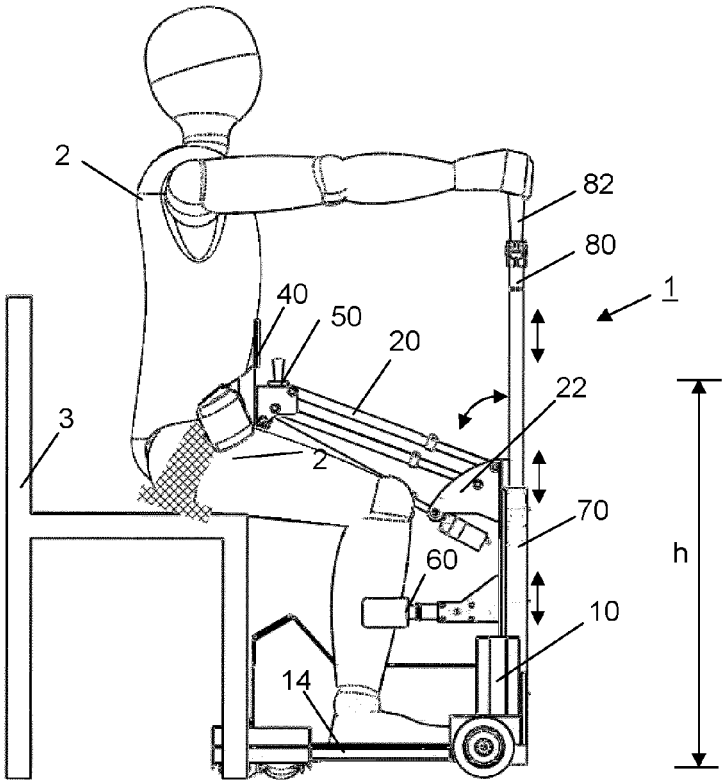
Figure 4:
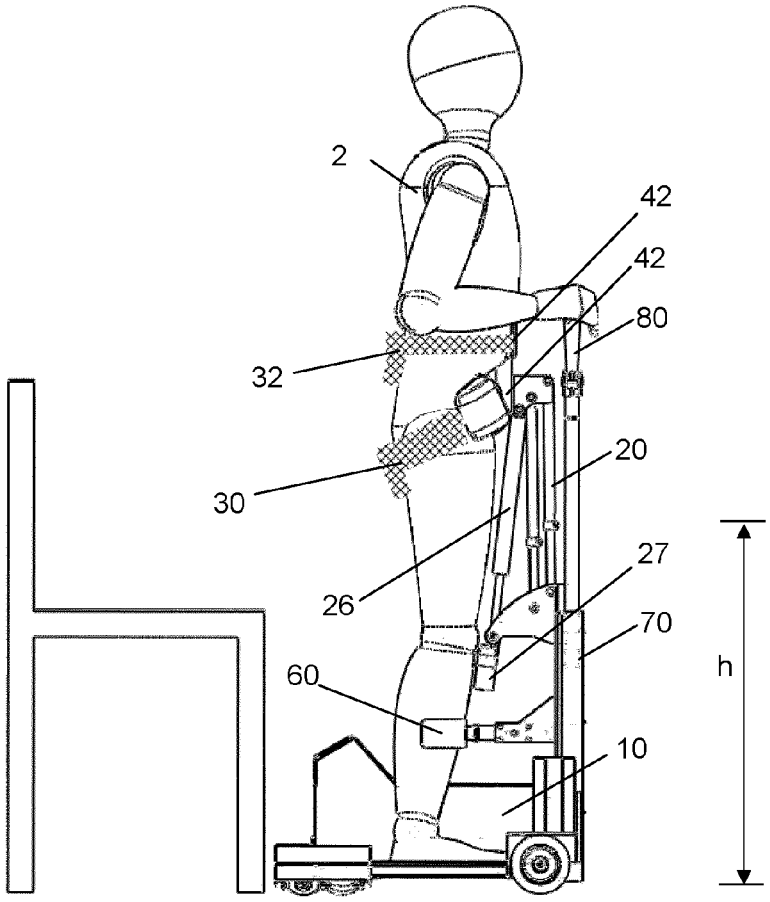
Figure 5:
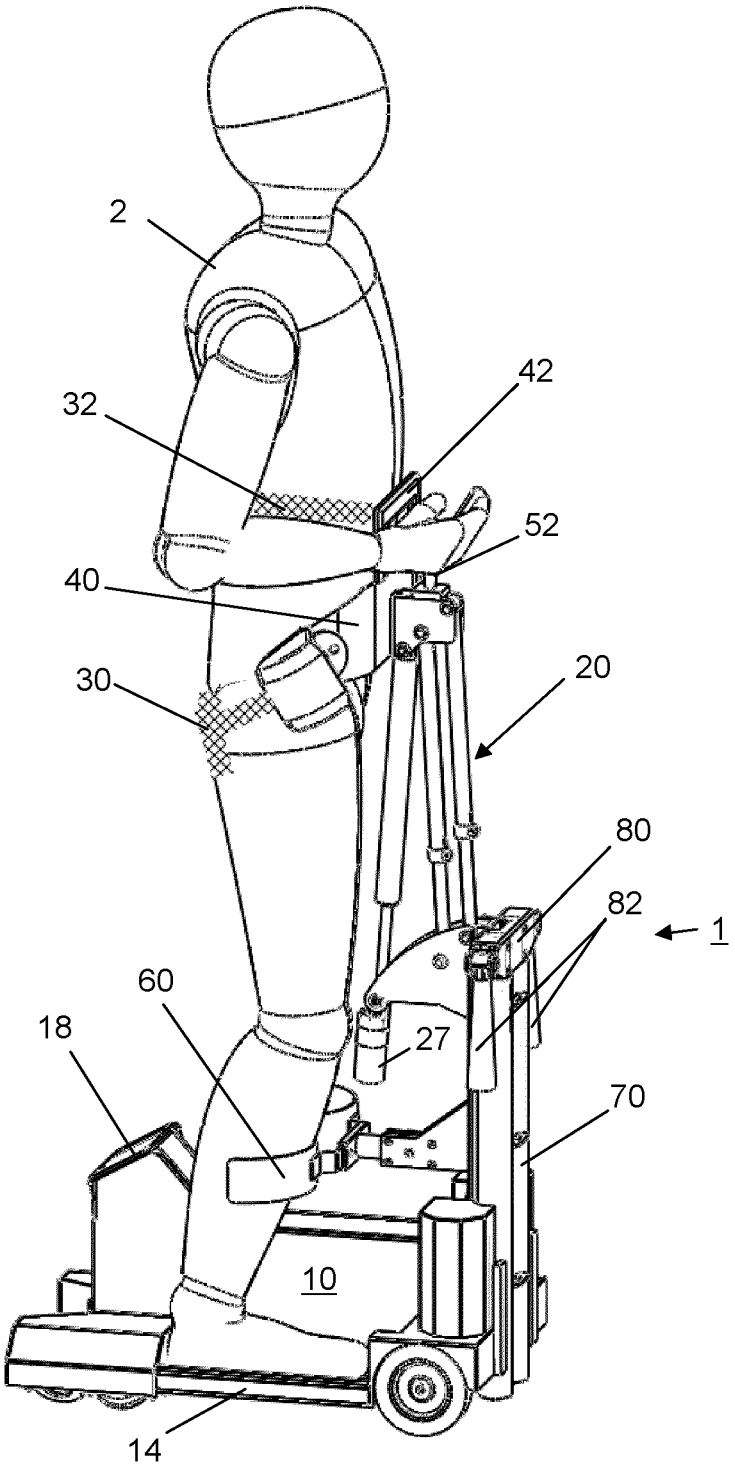
Figure 6:
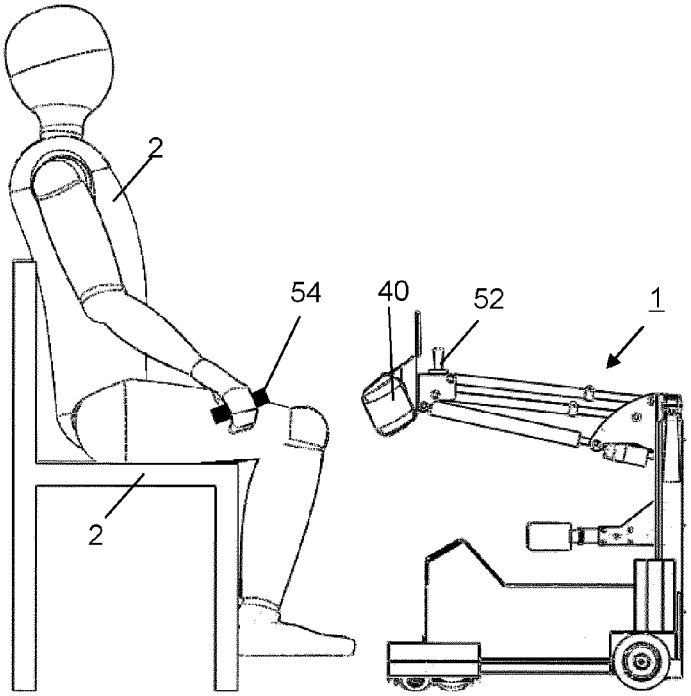
Figure 7:
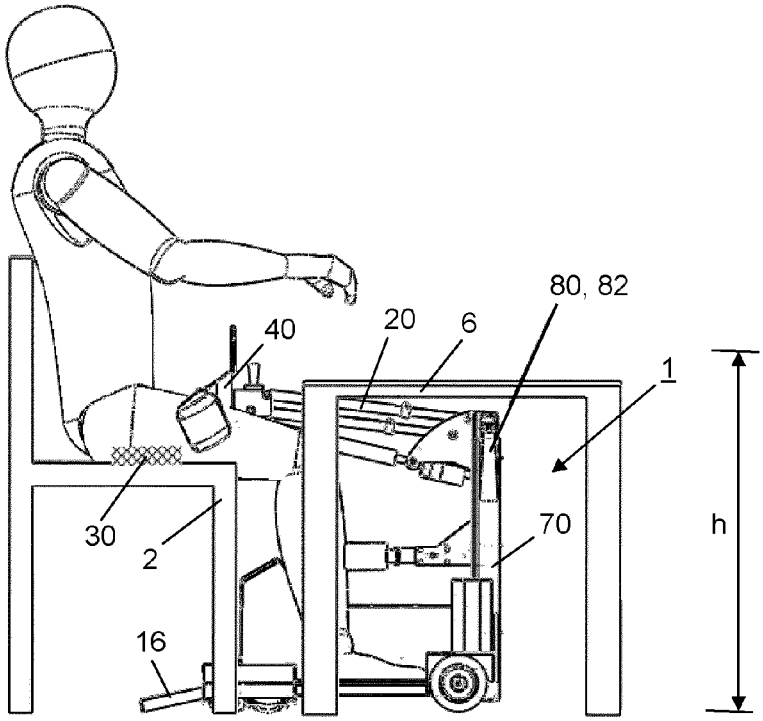
Figure 8:
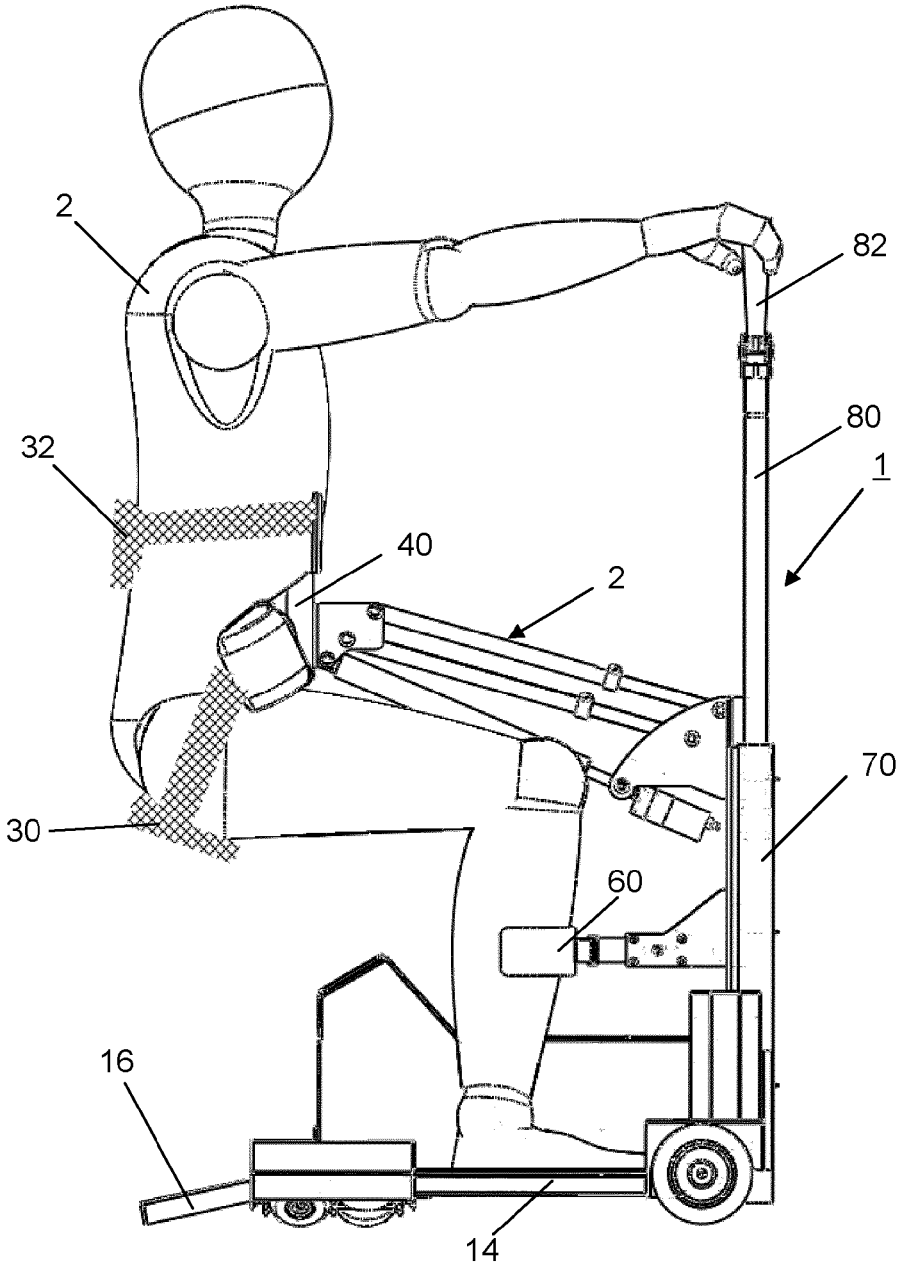
Figure 9:
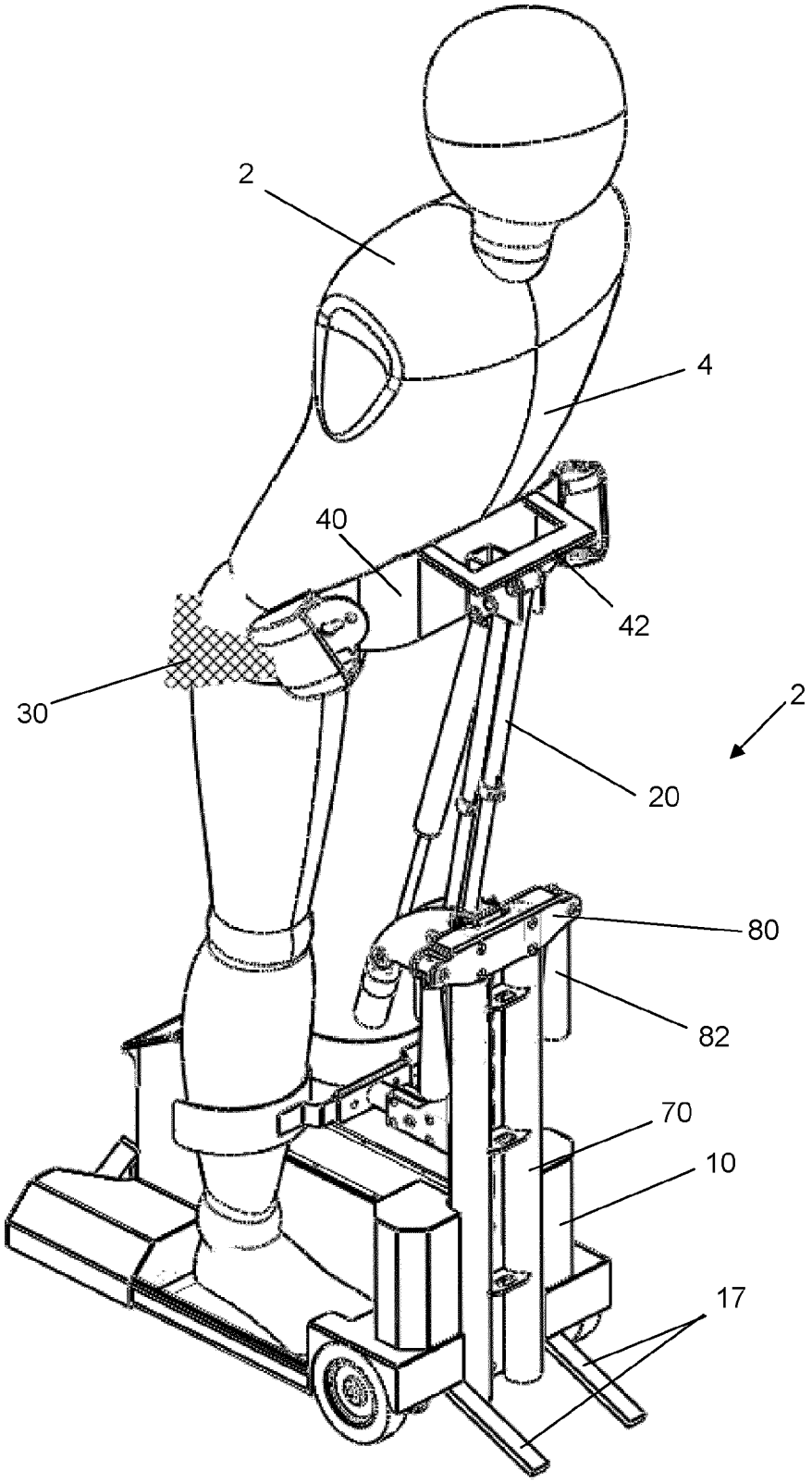
Figure 10:
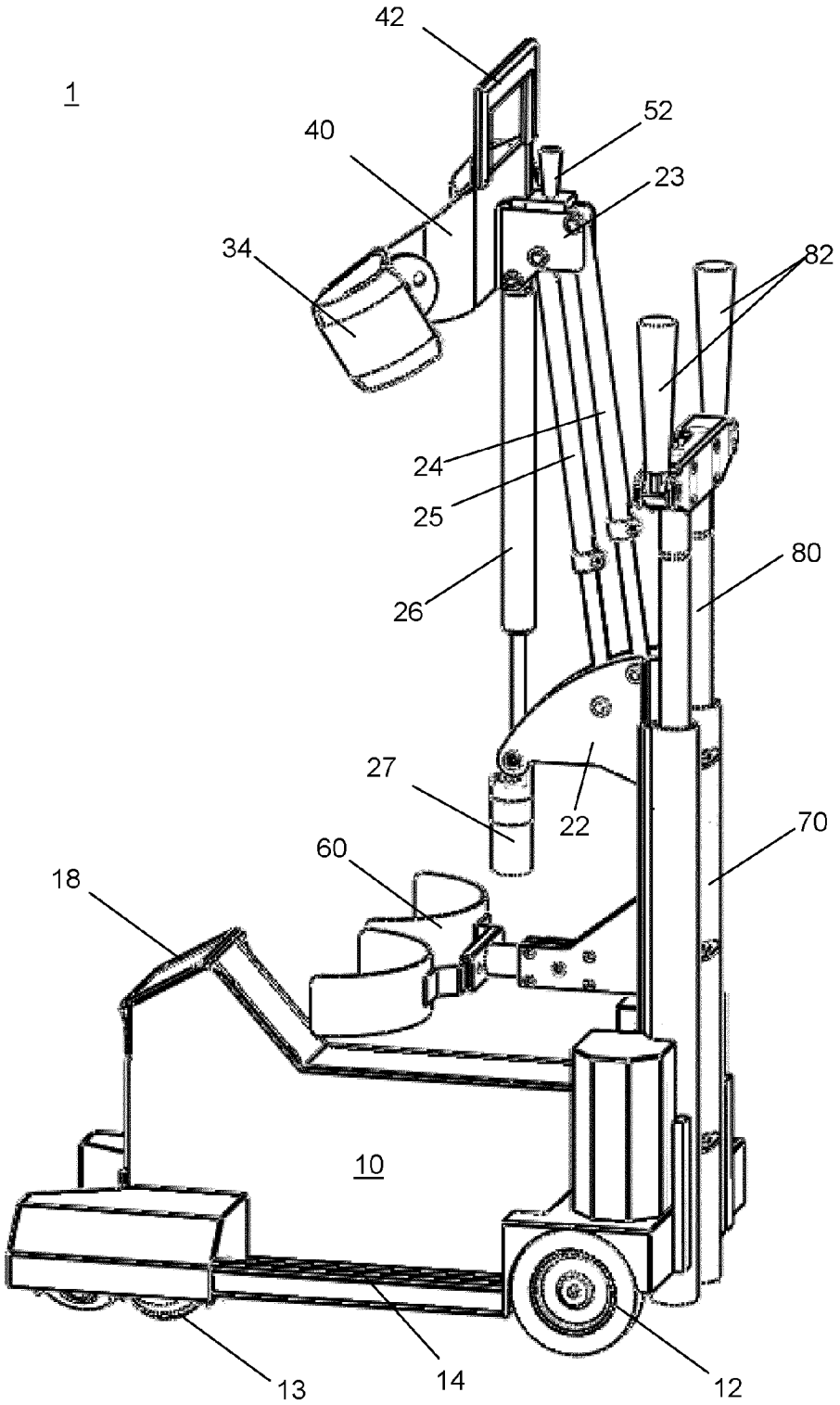
Figure 11:
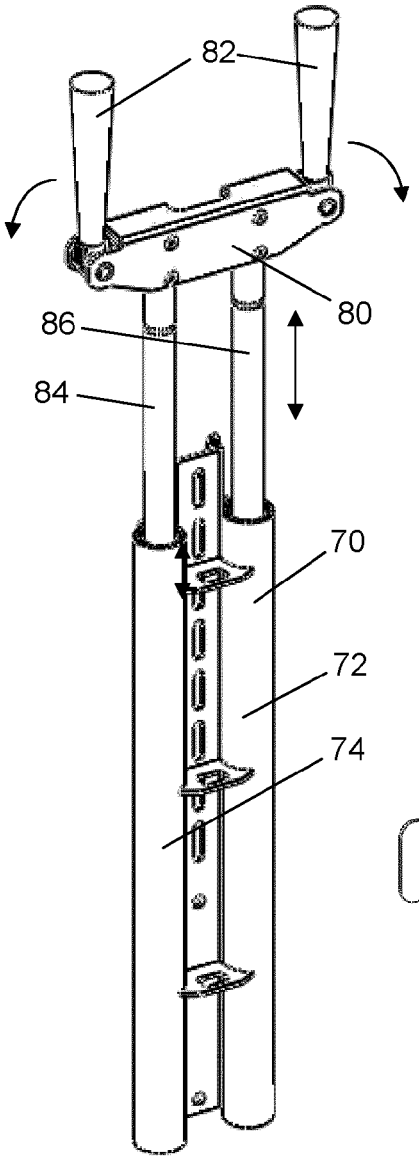
Figure 12:
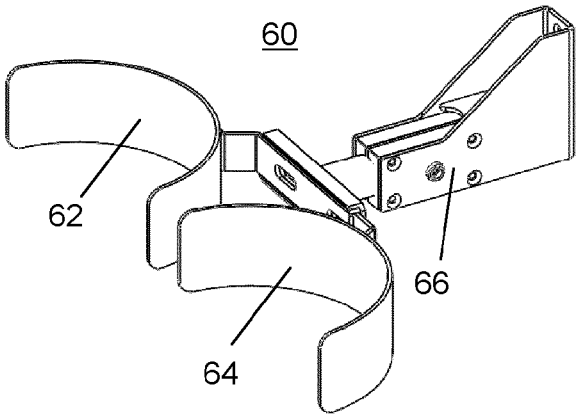
Figure 13:
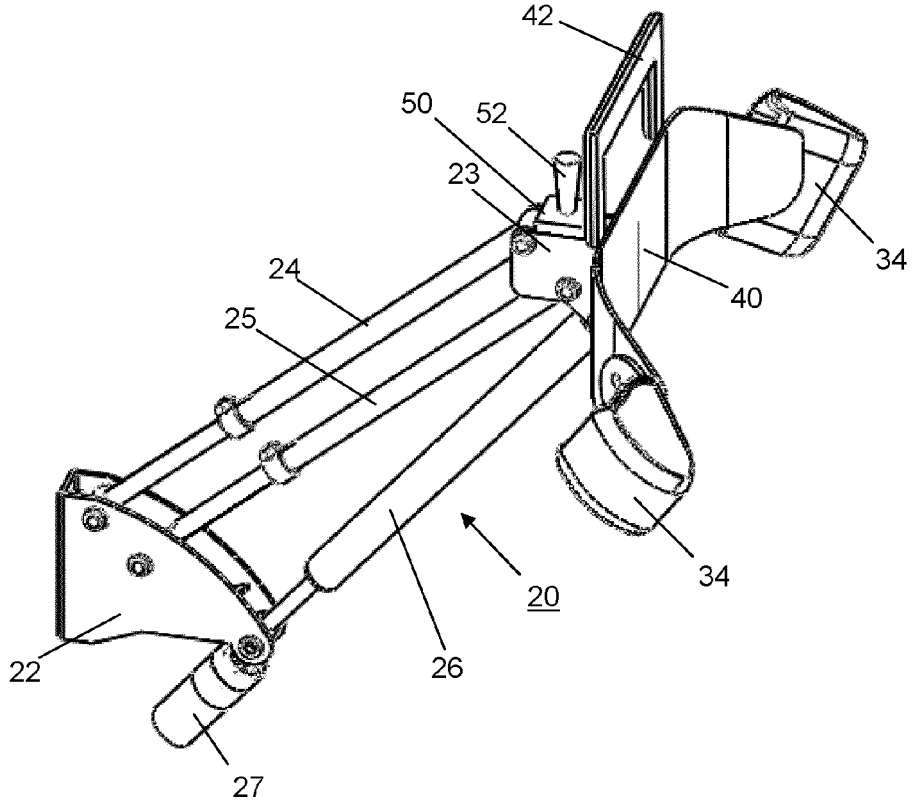
Figure 14:
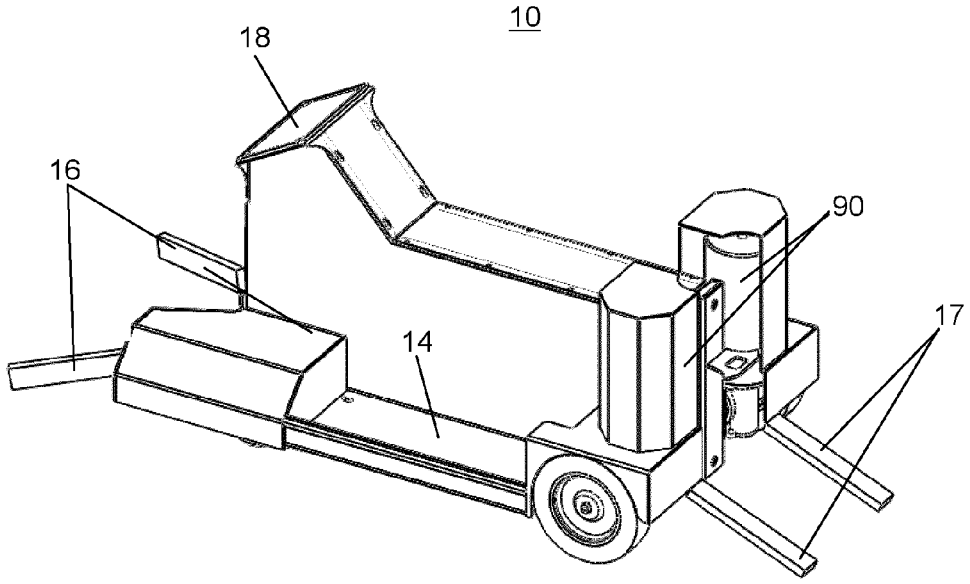
Figure 15:
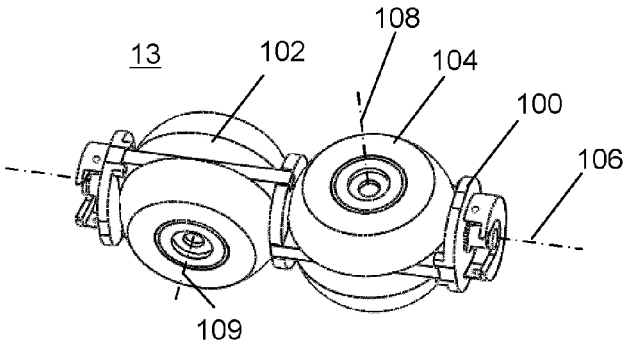
Figure 16:
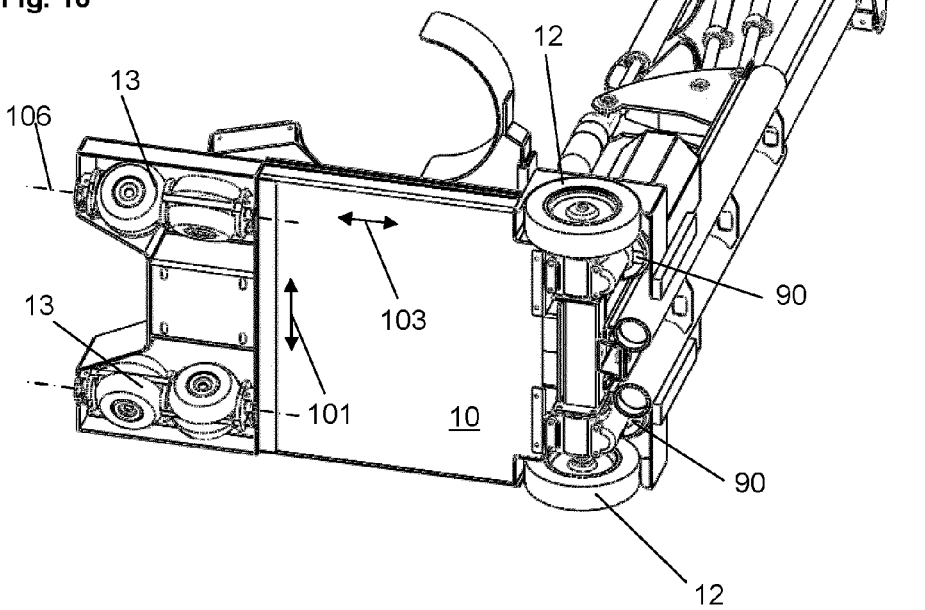
Figure 17:
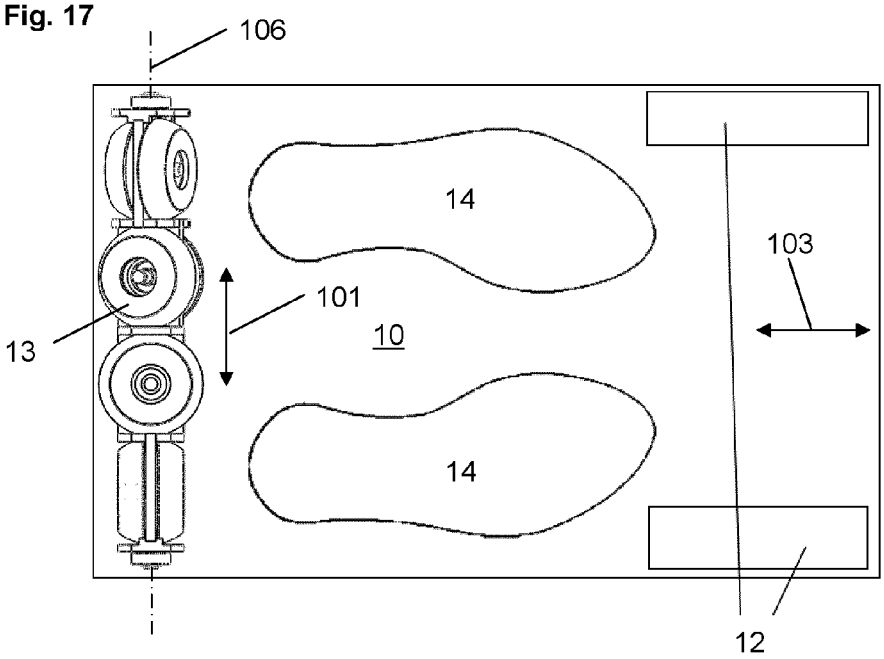
Figure 18:
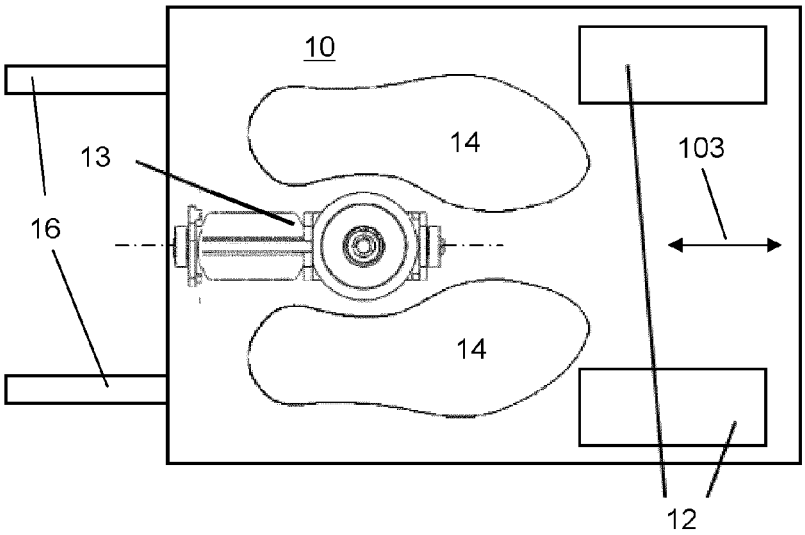
Figure 19:
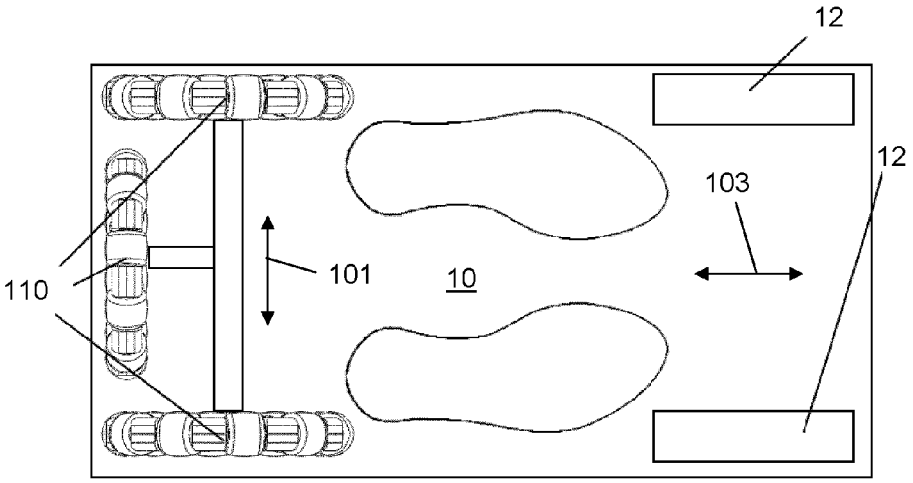
Figure 20:
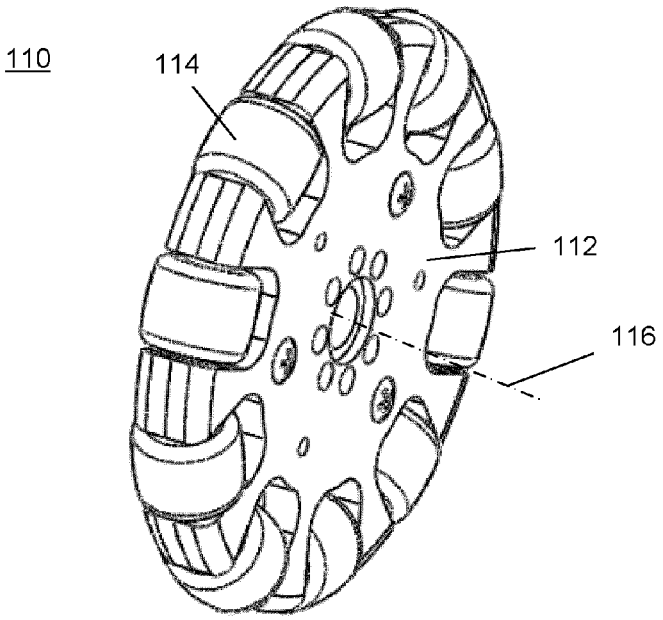
Figure 21:
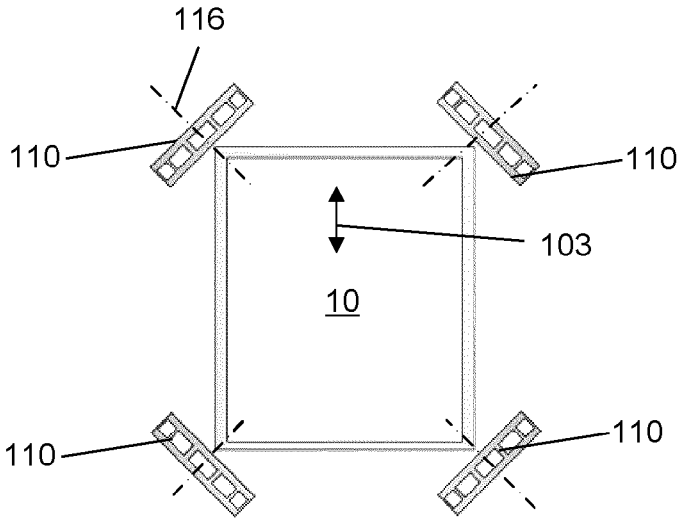
Figure 22:
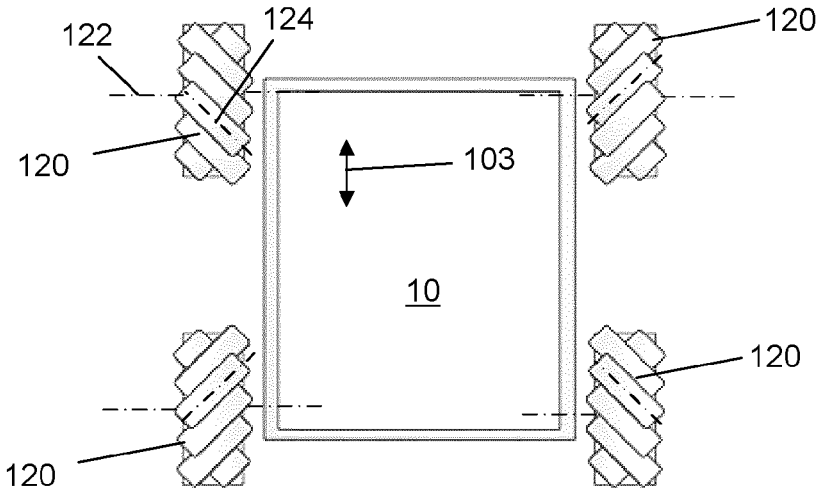
Figure 23:
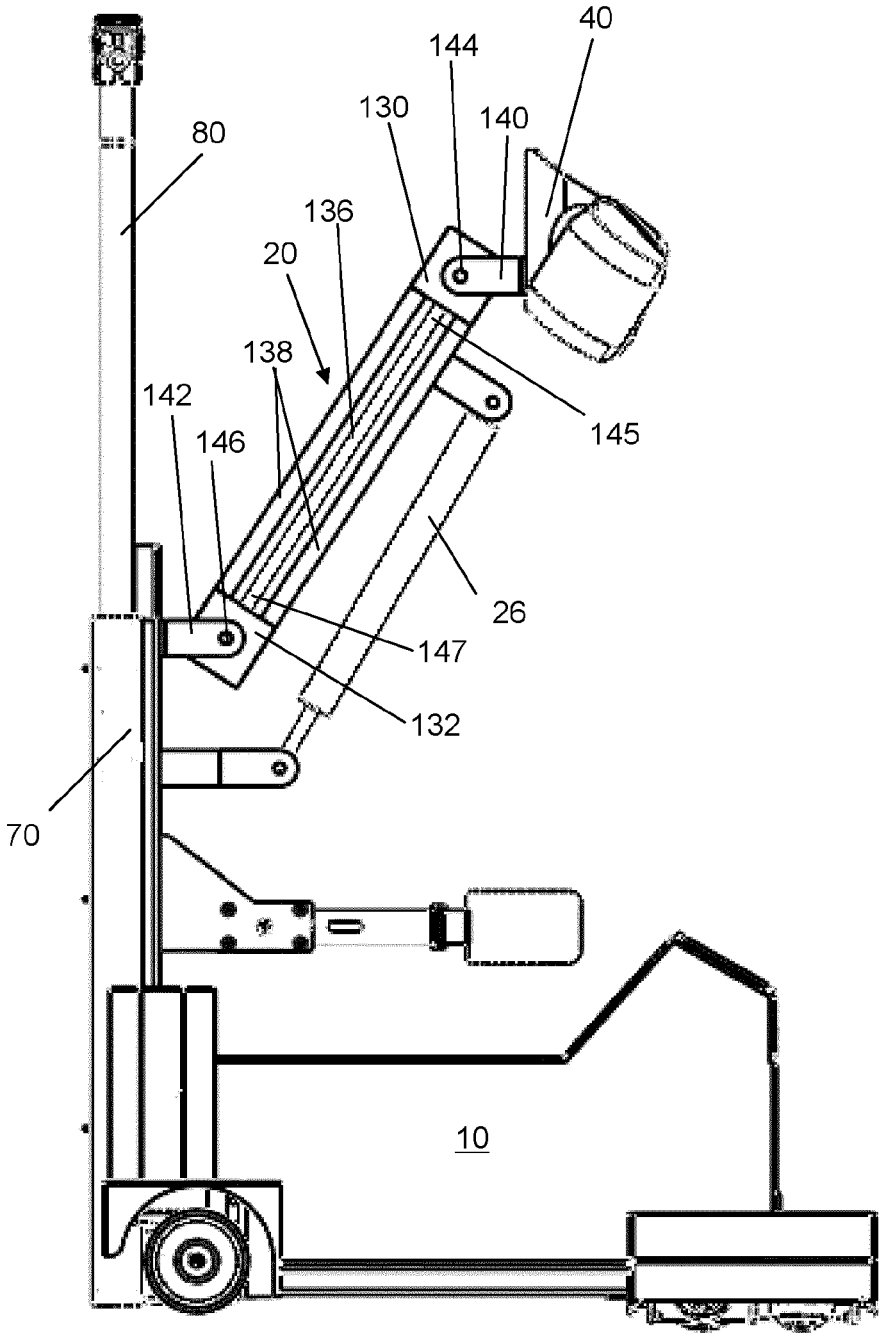
Figure 24:
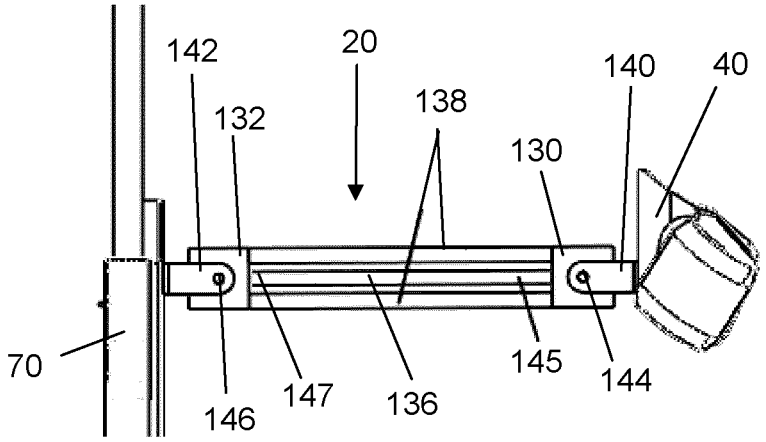
Figure 25:
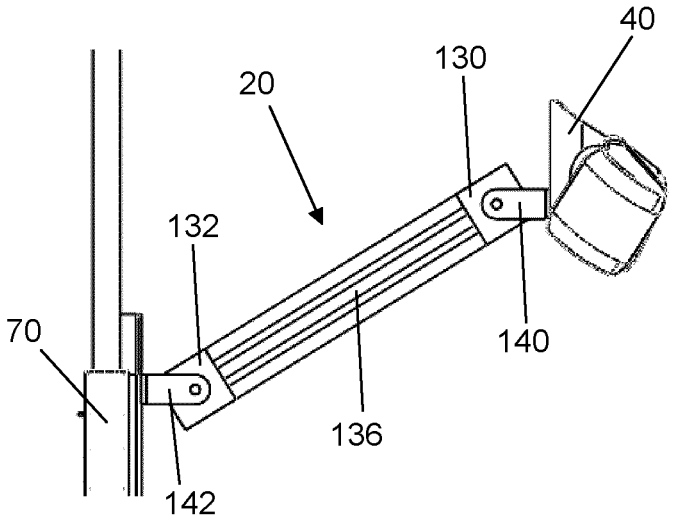
Figure 26:
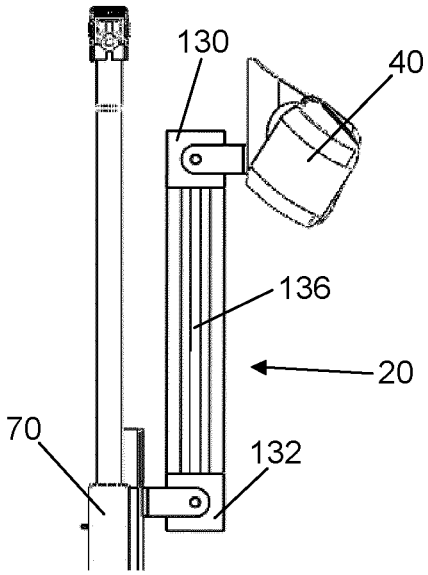
Figure 27:
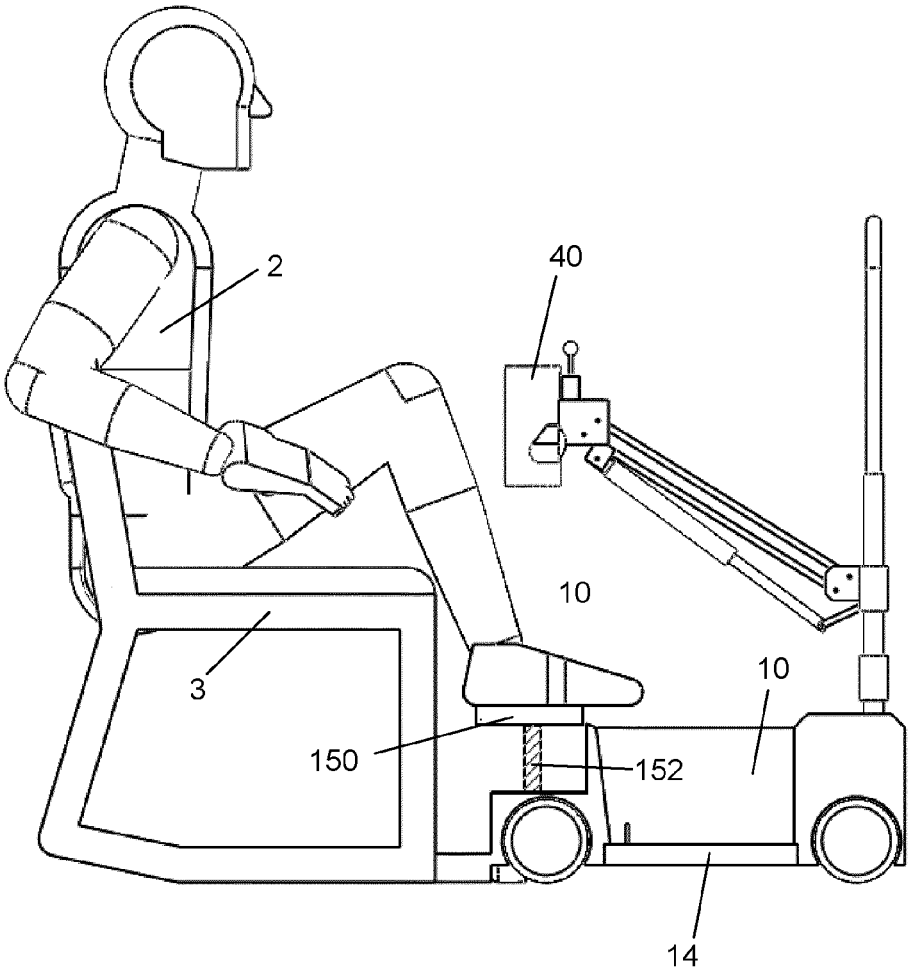

In the following preferred embodiments of the invention are described with respect to the drawings in which shows:

FIG. 1 a schematic side view of a preferred embodiment of a mobility device for physically disabled people during use in sitting position;

FIG. 2 a side view of the mobility device of FIG. 1, during the process of fixing a person;

FIG. 3 a schematic side view of the mobility device of FIG. 1 with extended handgrips just before the erection to the standing position;

FIG. 4 a schematic side view of the mobility device of FIG. 1 after the erection to the standing position;

FIG. 5 a three-dimensional view of a mobility device according FIG. 1 during use with a standing person and lowered hand grip arrangement;

FIG. 6 a side view of the mobility device according to FIG. 1 with a seated person using a remote control and all elements of the mobility device lowered to or below the waist height of the sitting person;

FIG. 7 a side view of the mobility device according to FIG. 1 with a person sitting at a table, wherein the mobility device is parked under the table;

FIG. 8 a side view of the mobility device according to FIG. 1, while the person lifts himself/herself up to the standing position;

FIG. 9 a three-dimensional view of a mobility device according to FIG. 1 while a standing person leans forward;

FIG. 10 a three-dimensional view of a mobility device according FIG. 1 with lifted pivot arm and partially extended hand grip arrangement;

FIG. 11 a detailed view of the extendable hand grip arrangement of a mobility device according to FIG. 1;

FIG. 12 a three-dimensional detailed view of a tibia support of the mobility device according to FIG. 1;

FIG. 13 a three-dimensional detailed view of a pivot arm with pelvis support and control panel of a mobility device according to FIG. 1, FIG. 14 a three-dimensional detailed view of a chassis of a mobility device according to FIG. 1 with extended stability elements to the front and to the back;

FIG. 15 a three-dimensional view of an embodiment of a multiway wheel;

FIG. 16 a three-dimensional detailed view of the underside of a chassis of a mobility device according to FIG. 1 comprising two multiway wheels and two driven wheels;

FIG. 17 a schematic view of the underside of a chassis of a mobility device comprising one multiway wheel and two driven wheels;

FIG. 18 a schematic view of the underside of a chassis of a mobility device comprising one multiway wheel and two driven wheels;

FIG. 19 a schematic view of the underside of a chassis of a mobility device comprising three omni wheels and two driven wheels;

FIG. 20 a three-dimensional view of an embodiment of an omni wheel;

FIG. 21 a schematic view of the underside of a chassis of a mobility device comprising a holonomic drive with four driven omni wheels;

FIG. 22 a schematic view of the underside of a chassis of a mobility device comprising a mecanum drive, comprising four mecanum wheels;

FIG. 23 a side view of a further preferred embodiment of a mobility device for physically disabled people, with a pivot arm having a gearbox arrangement;

FIG. 24 a side view of the pivot arm of the embodiment of FIG. 23 in horizontal position;

FIG. 25 a side view of the pivot arm of the embodiment of FIG. 23 in inclined position;

FIG. 26 a side view of the pivot arm of the embodiment of FIG. 23 in vertical position; and FIG. 27 a schematic side view of another preferred embodiment of a mobility device for physically disabled people with a height movable platform during use.

5. DESCRIPTION OF PREFERRED EMBODIMENTS

In the following preferred embodiments of the invention are described with respect to the accompanying figures. The FIGS. 1-10 show a first preferred embodiment of a mobility device for physically disabled people 1 during its use by a physically disabled person 2.

The mobility device 1 as main elements comprises essentially a maneuverable chassis 10, a pivot arm 20 and a pelvis support 40 that can directly touch the body of person 2. The pivot arm 20 is connected to the chassis by means of a perpendicular support post 70. For fixing the tibia of a person 2 at the support post 70 a tibia support 60 is provided in a height adjustable manner. For fixing the pelvis respectively the upper body of the person 2 to the pelvis support 40 a two piece fixing belt 30, 32 is connected to the pelvis support 40. By means of a control panel 50 at which a joystick 52 is connected the person 2 can control the mobility device 1, particularly the driving movements.

The chassis 10 comprises at least one motor, which preferably electrically selectively drives at least some of the wheels 12, 13 such that the mobility device 1 can be driven by person 2 in arbitrary manner. As shown in FIG. 1, chassis 10 only requires very little space and particularly has a low height of less than waist height h of a sitting person, particularly a height of 0.5 m-0.85 m, preferably 0.55 m-0.75 m, more preferred 0.6 m-0.7 m, and even more preferred below 0.7 m such that it can be moved essentially completely below a seating furniture 3 without any problems like the shown chair.

Chassis 10 further comprises on the right and on the left side in directly between the front wheels 12 and the back wheels 13 a footrest respectively for the right and left foot of the person 2. The footrests 14 on the one hand provide a good support for the feet of the person 2 during sitting and during the erection and on the other hand allow person 2 to conveniently stand on the mobility device 1. The footrests 14 can be height movable by means of a motorized mechanism in order to lift the upper legs of a seated person 2 for facilitating the fixing of the pelvis support 40 by means of the fixing belt 30, 32.

In chassis 10 the required motors for the drive of the front and back wheels 12, 13 as well as the power supply and the control electronics of the mobility device 1 are enclosed.

At the frontal area 17 of the chassis 10 a support post 70 is erected essentially vertically from the chassis 10 to the top. At this support post 70 a tibia support 60 is supported in an adjustable manner. FIG. 12 shows the tibia support 60 in more detail. The tibia support 60 comprises two concave and cushioned tibia holders 62 and 64 that are mounted to a holder 66. The holder 66 can be mounted at a desired height at the support post 70, see FIG. 10. The holder 66 additionally allows adjusting the length and orientation of the tibia support 70. Thereby, the tibia support 70 can be adjusted in order to perfectly support the tibia bones of the user 2 and to ensure a safe standing position of the user onto the mobility device 1.

Further, at the support post 70 the lower end 22 of the pivot arm 20 is supported in a height displaceable manner in order to adapt the pivot arm 20 to the physically disabled person 2.

The support post 70 is removable from the chassis 10 in order to facilitate transportation of the mobility device 1 for example in a car.

As it can be seen in detail in FIG. 13 at the lower end 22 of the pivot arm 20 also an actuator 26 is mounted, which acts for supporting the movement of the pivot arm 20 to the top. Preferably the actuator 26 is a lockable gas spring 26 that supports the upwards movement of the pivot arm 20 in different modes if desired. By means of a gas spring locker 27 the user 2 can select the locking mode of the gas spring 26 corresponding to the desired task (sitting, standing up, sitting down, driving around). Other actuators for locking the pivot arm 20 are also possible for example a common spring, an electric drive or other devices.

In the free mode the gas spring 26 enables that the pivot arm 20 can freely move up and down. This mode can be used if the person is sitting and no support by the mobility device is required.

In the locked mode the gas spring 26 prevents any up and down movement of the pivot arm 20. This mode can be used during driving around or standing with the mobility device 1 since it securely fixes the body of the person 2 during the driving, see FIGS. 4 and 5.

In the standing up mode the gas spring 26 enables the pivot arm 20 to move upwards and biases the pivot arm 20 in the upwards direction. However, in the standing up mode a downwards movement of the pivot arm 20 is prevented by means of the gas spring 26. This mode ensures that the user 2 can pull himself up to the standing position even if he/she requires several steps for a complete erection, see FIG. 3.

In the sitting down mode the gas spring 26 enables the pivot arm 20 to only move downwards and dampens this downwards movement by its upwards biasing force. In this mode an upwards movement of the pivot arm 20 is prevented.

The pivot arm 20 is preferably formed as a parallelogram arrangement of two parallel rods 24, 25 such that the pelvis support 40 and joystick 52 which are attached to the upper end 23 of the pivot arm 20 are essentially arranged by pivot joints always in the same orientation. The rods 24, 25 are length adjustable, preferably telescopic such that the pivot arm 20 can be adjusted in its length to the needs—for example the height—of the individual user 2.

Another embodiment of a pivot arm 20 is shown in FIGS. 23-26. In this embodiment the pivot arm 20 comprises a gearbox arrangement 130, 132, 136 in order to maintain the orientation of the pelvis support 40 in any pivot position of the pivot arm 20. The gearbox arrangement comprises at the upper end of the pivot arm 20 a first gearbox 130 and at the lower end of the pivot arm 20 a second gearbox 132. Both gearboxes 130, 132 include a set of gears that transmit a rotational movement of output shafts 144, 146 into rotational movements of input shafts 145, 147 and vice versa. The output shafts 144, 146 are perpendicularly arranged to the input shafts 145, 147. The housings of the gearboxes 130 and 132 are rigidly connected to each other by means of connection rods 138 or other appropriate means.

The input shafts 145, 147 are connected to each other by means of a connection shaft 136. Further, output shaft 144 of the first gearbox 130 is connected to the pelvis support 40 via a bracket 140. The output shaft 146 of the second gearbox 132 is connected to the support post 70 of chassis 10 via a further bracket 142.

The function of the pivot arm 20 with gearbox arrangement 130, 132, 136 is as follows: If the pivot arm 20 is pushed upwards the bracket 142 rotates the output shaft 146 of second gearbox 132. This causes a corresponding rotation of the input shaft 147 and the connection shaft 136. Preferably the rotational movement of the connection shaft 136 is a multiple of the rotational movement of the output shaft 146.

A rotation of the connection shaft 136 causes a rotation of the input shaft 145 of the first gearbox 130. This further causes a corresponding rotation of the output shaft 144 of the first gearbox 130. Both gearboxes 130, 132 are identical in view of the internal set of gears. Therefore, the rotation of the output shaft 146 of the second gearbox 132 is transmitted to a corresponding rotation in opposite direction of the output shaft 144 of the first gearbox 130. This in the end causes that the pelvis support 40 always maintains its initial orientation, as it can be seen in the FIGS. 24-26 even if the pivot arm 20 is pivoted to a different position.

Such an arrangement can favourably be used to lock the movement of the pivot arm 20 by engaging the connection shaft 136 appropriately. Since the connection shaft 136 has a higher rotational movement compared to pivot movement of the pivot arm 20 only a fraction of the force is needed for the locking compared to a direct locking of the pivot arm 20.

Additionally compared to a parallelogram arrangement 24, 25 of the first embodiment, as shown in FIG. 13, the gearbox arrangement 130, 132, 136 minimizes the danger of injury since the hand or fingers of users can not be caught between approaching rods 24, 25.

Further the gearbox arrangement 130, 132, 136 enables to motorize the movement of the pivot arm 20 by engaging the connection rod 136 by means of an electric motor (not shown). This enables a very compact motorized pivot arm 20.

As shown in FIGS. 1 and 4 the pelvis support 40 supports the hip respectively belly area 4 of person 2, if the person 2 is sitting. Person 2 in this position can be fixed by a two-part fixing belt 30, 32 that comprises an upper fixing belt 32 and a lower fixing belt 30 to the pelvis support 40. The upper fixing belt 32 may be used if person 2 can not stabilize its upper body by muscle force. In such a case the upper body of the person 2 is additionally stabilized by an upper extension 42 of the pelvis support 40 (see FIG. 5). As it can be seen in FIG. 9 the upper extension 42 can be folded away if the person 2 wants to lean forward in the standing position.

As shown in FIG. 1 this fixing of person 2 does not negatively affect person 2 during sitting on arbitrary seating furniture 3. It is a big advantage of mobility device 1, that it can be used simultaneously together with different seating furniture 3 without negatively affecting the sitting person 2 during its activities. As it can be seen in FIG. 7 the low shape of chassis 10 as well as the possibility to lower pivot arm 20 and handgrip 80 the mobility device 1 can also be used if person 2 is sitting at a table 6 or works at a computer. In these cases mobility device 1 is located essentially totally below the seat 3 and below the table 6. All elements for example the hand grip arrangement 80 and the pivot arm 20 that during use need to be extendable above a waist height h of the person 2 using the mobility device 1 can be lowered or maneuvered below this height h, such that the mobility device can be located essentially below a table (see FIG. 7).

In a preferred embodiment chassis 10 is approximately only 0.4-0.7 meters long, 0.2-0.4 meters high and 0.3-0.5 meters wide. Thereby, on the one hand it is ensured that the mobility device 1 can be manoeuvred securely with a standing person 2 and on the other hand does not negatively affect a sitting person 2.

As it can be seen in FIGS. 8, 9, 14 and 18 for increasing the stability of the mobility device 1 during manoeuvring back sided stability elements 16 and front sided stability elements 17 can be extended or pivoted out of the chassis 10. Such support elements 16, 17 by abutting the floor improve the tilting security if person 2 drives around or stands with the mobility device 1. The stability elements 16, 17 can automatically be extended out of chassis 10 during sitting down, as shown in FIG. 8, or while the person 2 leans forward, as shown in FIG. 9. To this end sensors may be provided that sense forces and/or accelerations acting on the mobility device 1 in order to detect a critical tilting situation. In another embodiment the stability elements 17 are automatically extended depending on the position of additional support elements 42 that additionally can support the upper body of person 2 from the front. Alternatively or additionally the back sided stability elements 16 may automatically extend out of the chassis 10 when the pivot arm 20 is moved down, is in an intermediate position, or is presently moving. During driving the stability elements 16, 17 usually are pivoted inside or retracted in order to minimize the space consumption of the mobility device 1 and to improve the ability for maneuvering.

As shown in FIGS. 3, 10 and 11 a handgrip arrangement 80 comprises two handgrips 82 by which the user 2 can pull himself/herself up to a standing position and can hold himself/herself during driving around. In order to reduce the overall height of the mobility device 1 the handgrips 82 can be folded downwards at the handgrip arrangement 80 as indicated by the arrows in FIG. 11. Additionally the handgrip arrangement 80 comprises two handgrip tubes 84, 86 that are telescopically supported within two tubes 72, 74 of the support post 70. This further allows to adjust the handgrips 82 to the desired height, preferably above waist height h and to lower the handgrip arrangement 80 below this height in case the user 2 wants to sit at a table or wants to move the handgrip arrangement 80 out of sight.

FIG. 2 shows the person 2 sitting on seating furniture 3, during the process of fixing of the mobility device 1 to its body. To this end, person 2 preferably places its feet to the specifically provided back sided edge platform 18 of the chassis 10, such that the upper legs are slightly lifted from the seat plane of the seat 3. Thereby, the knees of the person 2 can be favourably prevented from lateral deflecting by means of the pelvis support 40. In this position it is easy for person 2 to guide fixing belts 30, 32 below the bottom and then to fix pelvis support 40 safely to its body as shown in FIG. 1.

This procedure can be facilitated by a height movable platform 150 that can be moved up and down by a motorized mechanism 152 as shown in FIG. 27. Thereby, the mobility device 1 can be made very compact and—if needed—the feet of the person 2 can be lifted in a motorized way, preferably to fix the belt 30, 32 of the pelvis support 40 to the hip of the person 2.

Alternatively the footrests 14 can also be movable in height by means of a motorized mechanism. This further allows a perfect sitting on any seating furniture while the feet of the person remain on the mobility device. Additionally motorized footrests 14 allow an effortless lifting of the upper legs of the person 2 for an easy fixing of fixing belts 30, 32.

As shown in FIG. 2 person 2 fixes itself from the backside of mobility device 1. This is possible since mobility device 1 does not comprise any seat, but only supports person 2 from the front by pelvis support 40 and by the tibia support 60, and from below by the footrests 14 and from the back by the fixing belts 30, 32. This omission of an own seat and the particular arrangement of mobility device 1 enables that person 2 can use arbitrary seating furniture 3, for example chairs, seats or even beds without having to change between such seating furniture and a wheel chair if person 2 want to be mobile. Further, this facilitates a fixing of the mobility device 1 by the physically disabled person on its own without any further helping persons.

The additional support elements 42 are provided to additionally support the upper body of person 2 from the front, the side or from the back if person 2 is not able to stabilize its upper body by muscle force. These additional support elements 42 may also be mounted to the pivot arm 20. As it can be seen in FIG. 9 the support elements 42 are preferably designed such that they can be folded away or retracted such that they do not hinder the person 2 while performing specific tasks like for example during washing. This folding away of the support elements 42 can cause that the stability elements 17 are automatically extended out of the chassis 10 which prevents a tilting of the mobility device 10 to the front. The same principle can be used for the back stability elements 16.

If person 2 wants to change its position in the room, it will pull itself up—as shown in FIG. 3—to a standing position—as shown in FIGS. 4 and 5—by means of the handgrips 80, 81. This pulling up can be mechanically supported by an actuator 26 like for example a spring or the preferred lockable gas spring.

The actuator 26 can also be provided as a motor-driven element such person 2 can also erect itself without force effort or less force effort from the sitting into the standing position. In this case, actuator 26 can be provided as a hydraulic cylinder, as an electric spindle actuator, a DC driven motor or the like. The pivot movement of the pivot arm 20 as well as the driving movements of the mobility device 1 can be controlled by the person 2 at a control panel 50, which preferably comprises a joystick 52 for the control of the driving movements. In case the actuator 26 is strong enough to lift the person 2 alone from the sitting to the erected position in some embodiments hand grips 80, 81 would not be needed anymore.

In order to control the mobility device 1 from a remote position a wireless remote control 54 can be provided. By means of a wireless remote control 54 the user 2 can preferably control the driving movements of the mobility device 1 which allows him/her to fetch the mobility device 1 from a remote position to the actual position of the user 2. This enables the user 2 to use the mobility device 1 without the need of a further assistant, for example already in the morning in order to leave the bed.

The mobility device 1 is preferably driven by electric motors 90 that drive the front wheels 12 of the mobility device 1 via corresponding gear boxes, see FIG. 16. There are various ways to arrange driven and non driven wheels at the chassis 10.

In a first embodiment of FIG. 1 and FIG. 16 the driven wheels 12 are arranged at the front corners of the chassis 10. In this embodiment the wheels 12 are not steerable but may rotate independently from each other backwards or forwards. At the back corners of the chassis 10 two so called multiway wheels are supported at the chassis 10. Multiway wheels are able to rotate around more than one rotation axis so that the wheels can be used to move forward but also sideways, i.e. perpendicular thereto.

FIG. 15 shows one embodiment of a multiway wheel 13. The multiway wheel 13 comprises a carrier 100 that is rotatably mounted around a rotation axis 106 at the chassis 10. At this carrier 100 two pair of casters 102 and 104 are rotatably mounted that can rotate around rotation axes 108 and 109. As it can be seen the rotation axes 109 and 108 are perpendicular to the rotation axis 106 of the carrier 100 and perpendicular to each other. Further, the overall projection of the casters 102, 104 in direction of the rotation axis 106 assembles approximately to a circle. This enables that the back of the mobility device 1 may move sideways as indicated by arrows 101. This allows a better agility and steerability of the mobility device 1. During the sideways movement the multiway wheels 13 rotate around the axis 106, whereas during a forward and backward movement of the mobility device 1 as indicated by arrow 103 the casters 102, 104 rotate around the axes 108, 109, respectively.

FIG. 17 shows another embodiment, where one multiway wheel comprises four pairs of casters that have rotation axes that are arranged 45° to each other at a common carrier. The carrier can rotate around an axis 106 that is laterally arranged at the chassis 10. The 45° angular offset of the rotation axes provide a smoother drive in longitudinal direction of the chassis 10.

FIG. 18 shows another embodiment where one multiway wheel is arranged in between the foot rests 14 in order to decrease the length of the chassis 10 and the overall length of the mobility device 1. In this case for a save driving the back sided stability elements 16 will be extended from the chassis 10.

In the embodiment of FIG. 19 three so called "omni wheels" 110 are used that are shown in detail in FIG. 20. The omni wheels 110 comprise a wheel shaped carrier 112 to which—at the outer periphery thereof—a plurality of casters 114 are rotatably mounted. The rotation axes of the casters 114 are perpendicular to the main rotation axis 116. Therefore, like the multiway wheels the omni wheels allow a movement in longitudinal direction 103 and transversal direction 101. In order to increase the stability the third omni wheel 110 at the back of the chassis 10 is provided that has a main rotation axis 116 perpendicular to the main rotation axes of the two lateral omni wheels 110. In another embodiment this third omni wheel 110 could be omitted in order to drive more comfortably over obstacles.

Instead of the omni wheels 110 in the embodiment of FIG. 19 also at least one caster wheel (not shown) can be used.

As it can be seen in FIG. 21 it is possible to mount four omni wheels 110 to the corners of chassis 10 wherein the rotation axes are 45° offset to the main driving direction. This arrangement is called "holonomic drive". By driving each of the four omni wheels 110 individually the chassis 10 can rotate on place and move in any arbitrary direction.

A similar arrangement is shown in FIG. 22 that shows a so called "mecanum drive". In this embodiment four mecanum wheels 120 are mounted at the chassis 10. Each mecanum wheel 120 comprises individually rotatably supported rollers that have a rotation axis 124 that is 45° offset to the main rotation axis 122 and that are arranged a base element of the mecanum wheel 120. By driving each of the four mecanum wheels 120 individually the chassis 10 can rotate or move in any arbitrary direction. In another embodiment (not shown) two mecanum wheels 120 could be combined with two other kind of wheels. In a mecanum drive and in a holonomic drive it is not necessary that the single wheels 110, 120 can be steered.

The use of such driving concepts for a mobility device 1 increases the agility and steerability of the mobility device 1 and, thereby, the applicability of the mobility device 1 in the daily life of physically disabled people.

The mobility device 1 provides a new class of mobility devices, which replaces a wheelchair as well as lifting devices in the household area. Since the possibility of a self-erecting of a sitting person 2 into the standing position for driving around is already integrated into the mobility device 1 the mobility and reach of the person 2 is significantly improved. Compared for example to the use of a wheelchair and further lifting devices it is essentially faster and easier possible to change different seats and places by means of the mobility device 1. Helping persons are not necessary anymore. Further, by means of the mobility device 1 activities in sitting and standing position can be done easily and without problems. This significantly increases the quality of life of physically disabled people and enables an essentially self-determined daily life.

The invention claimed is:

1. A user drivable mobility device for physically disabled people (1), the user drivable motility device comprising:

a. a chassis (10) of the user drivable mobility device having front wheels (12) which are selectively driven by respective motors (90) in order to maneuver the entire mobility device (1);

b. a support post (70) rigidly arranged at a frontal area (17) of the chassis (10);

c. a pivot arm (20), which at its lower end (22) is pivotably connected to the chassis (10) via the support post (70); and d. a pelvis support (40), which is connected to an upper end (23) of the pivot arm (20);

e. wherein the pelvis support (40) is configured to be securely fixed to a belly or the frontal pelvis of the disabled person, and f. the mobility device (1) is configured to be movable around with the disabled person (2) standing on the chassis (10), wherein the driving movements of the mobility device (1) as well as the pivot movement of the pivot arm (20) for changing from sitting to standing position are configured to be controlled by the disabled person (2); and wherein g. the pivot arm (20), except the pelvis support (40) fixed to the body of the disabled person, can be lowered or moved to below a waist height (h) of a sitting person (2) such that it does not impair the vision to the front of the sitting person; and h. where the chassis further comprises footrests on the right and on the left side thereof directly between the driven front wheels and non-driven back wheels, the footrests respectively for the right foot and the left foot of the disabled person; and i. wherein the chassis is from 0.3 to 0.5 meters wide.

2. Mobility device for physically disabled people (1) according claim 1, further comprising a hand grip arrangement (80) that is movably supported, preferably telescopically supported at the chassis (10), wherein the hand grip arrangement (80) allows the physically disabled person (2) to erect himself/herself to a standing position.

3. Mobility device for physically disabled people (1) according to claim 1, wherein the hand grip arrangement (80) comprises two hand grips (82) that are foldable downwards.

4. Mobility device for physically disabled people (1) according claim 1, wherein the pivot arm (20) and the hand grip arrangement (80) can be moved to a height above pelvis height (h) of a sitting person (2).

5. Mobility device for physically disabled people (1) according to claim 1, the mobility device (1) has no seat for a person (2).

6. Mobility device for physically disabled people (1) according claim 1, further comprising stability elements (16, 17) that are extendable and retractable from the chassis (10) in order to provide an enhanced stability of the mobility device (1).

7. Mobility device for physically disabled people (1) according to claim 1, comprising an upper fixing belt (32) for fixing the upper part (4) of the body of a physically disabled person (2) and a lower fixing belt (30) for fixing the pelvis of a physically disabled person (2).

8. Mobility device for physically disabled people (1) according to claim 1, wherein at least one of the fixing belts (30, 32) is retractable into the pelvis support (40).

9. Mobility device for physically disabled people (1) according to claim 1, wherein the pivot arm (20) can be pivoted to a height below and above pelvis height (h) of a sitting person such that:

a. the pelvis support (40) can abut the belly of a sitting person (2);

b. a sitting person (2) with a fixed pelvis support (40) is able to erect himself/herself to a standing position; and c. the pelvis support (40) fixes the belly or the frontal pelvis of the person (2) and holds the person (2) upright in a standing position on the mobility device (1).

10. Mobility device for physically disabled people (1) according claim 1, wherein the pivot movement of the pivot arm (20) to the standing position (2) is supported by a spring, preferably a lockable spring, and more preferred by a lockable gas spring (26).

11. Mobility device for physically disabled people (1) according claim 1, wherein the pivot arm (20) can be selectively locked to provide at least two of the following modes:

a. free mode, such that the pivot arm (20) can move up and down;

b. locked mode, such that the pivot arm (20) can neither move up nor down;

c. standing up mode, such that the pivot arm (20) can only move up but can not move down;

d. sitting down mode, such that the pivot arm (20) can only move down but can not move up.

12. Mobility device for physically disabled people (1) according claim 1, wherein the pivot arm (20) is length adjustable in order to adjust the mobility device (1) to the user (2).

13. Mobility device for physically disabled people (1) according claim 1, further comprising two footrests (14) arranged at the chassis (10) as platforms for a person (2) standing on the mobility device (1), wherein the footrests (14) are arranged in between front wheels (12) and back wheels (13, 110, 114).

14. Mobility device for physically disabled people (1) according to claim 13, wherein the footrests (14) are height adjustable by a motorized mechanism.

15. Mobility device for physically disabled people (1) according claim 1, the pivot arm (20) is arranged as a parallelogram arrangement (24, 25) such that the pelvis support (40) during pivoting of the pivot arm (20) always has the same orientation.

16. Mobility device for physically disabled people (1) according claim 1, the pivot arm (20) further comprises a gearbox arrangement (130, 132) for maintaining the orientation of the pelvis support (40), while pivoting the pivot arm (20).

17. Mobility device for physically disabled people (1) according claim 16, wherein the gearbox arrangement (130, 132) comprises:

a. a first gearbox (130) at one end of the pivot arm (20);

b. a second gearbox (132) at the other end of the pivot arm (20);

c. a rotatable connection shaft (136) connecting input shafts (145, 147) of the first and second gearboxes (130, 132) with each other;

d. wherein a rotatable output shaft (144) of the first gearbox (130) is connected to the pelvis support (40); and e. a rotatable output shaft (146) of the second gearbox (132) is connected to the chassis (10).

18. Mobility device for physically disabled people (1) according to claim 1, wherein the support post is removably arranged at the chassis.

19. Mobility device for physically disabled people (1) according claim 18, wherein the lower end (22) of the pivot arm (20) is supported in a height displaceably manner at the support post (70).

20. Mobility device for physically disabled people (1) according claim 18, further comprising a tibia support (60) which is connected to the support post (70) in an adjustable manner.

21. Mobility device for physically disabled people according claim 1, further comprising at least one multiway wheel.

22. Mobility device for physically disabled people (1) according claim 1, further comprising a. at least one omni wheel (110); and/or b. at least one caster wheel; and/or c. a holonomic drive, comprising four omni wheels (110) arranged at the edges of the chassis (10); and/or d. a mecanum drive, comprising at least two mecanum wheels (120).

23. Mobility device for physically disabled people (1) according claim 1, further comprising at the back end of the chassis (10) a platform (18, 150) for supporting the feet of the person (2) while the person (2) is attaching a fixing belt (30, 32) to its body.

24. Mobility device for physically disabled people (1) according claim 23, wherein the platform (150) is height movable by means of a motorized mechanism (152).

25. Mobility device for physically disabled people (1) according claim 1, comprising a control panel (50) at which person (2) can control the movements of the mobility device (1), particularly the driving movements.

26. Mobility device for physically disabled people (1) according to claim 25, wherein the control panel (50) is a remote control panel that allows the user to manoeuvre the mobility device (1) from a remote distance.

* * * * *